US011319031B1

(12) United States Patent
Perry

(10) Patent No.: US 11,319,031 B1
(45) Date of Patent: May 3, 2022

(54) APPARATUS FOR SAFELY CONNECTING A BOAT TO ANOTHER BOAT OR OBJECT

(71) Applicant: Justin J. Perry, Fresno, CA (US)

(72) Inventor: Justin J. Perry, Fresno, CA (US)

( * ) Notice: Subject to any disclaimer, the term of this patent is extended or adjusted under 35 U.S.C. 154(b) by 0 days.

(21) Appl. No.: 15/646,061

(22) Filed: Jul. 10, 2017

(51) Int. Cl.
*B63B 21/56* (2006.01)
*B63B 21/00* (2006.01)

(52) U.S. Cl.
CPC ..... *B63B 21/56* (2013.01); *B63B 2021/006* (2013.01)

(58) Field of Classification Search
CPC ..... B63B 21/00; B63B 2021/001; B63B 2021/003; B63B 2021/004; B63B 2021/006; B63B 21/56
USPC ..... 114/230.1, 230.15, 230.17, 230.18, 114/230.19
See application file for complete search history.

(56) References Cited

U.S. PATENT DOCUMENTS 1,859,893 A 5/1932 Ritz-Woller
5,078,356 A 1/1992 Adams
5,676,085 A 10/1997 Michi, Jr.
6,475,048 B2 * 11/2002 Gredy ..... B63B 21/00 114/230.1
6,478,271 B1 11/2002 Mulholland
6,666,420 B1 12/2003 Carnevali
8,104,809 B1 1/2012 Mayhugh
8,790,148 B2 * 7/2014 Ehrat ..... E04H 4/14 441/129
9,695,974 B2 * 7/2017 Gordon ..... A45D 44/14

* cited by examiner

*Primary Examiner* — Daniel V Venne
(74) *Attorney, Agent, or Firm* — Richard A. Ryan

(57) ABSTRACT

An apparatus that is configured to connect a first boat to second boat or to an object, such as a dock, in a manner that prevents the surface of the first boat from contacting the surface of the second boat or the object. The apparatus comprises a connecting assembly having a first engaging mechanism at its first end and a second engaging mechanism at its second end. The connecting assembly comprises a pair of connecting members that are telescopically configured and a length adjusting mechanism that adjusts the length of the connecting assembly and the spacing provided by the apparatus. The length adjusting mechanism can include a locking mechanism that locks the connecting members or a biasing mechanism that biases the two members apart. The engaging members can be suction cups that have cup locking mechanisms that allow the user to lock the suction cups to a surface.

16 Claims, 5 Drawing Sheets

APPARATUS FOR SAFELY CONNECTING A BOAT TO ANOTHER BOAT OR OBJECT

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The field of the present invention relates generally to apparatuses that are beneficially utilized to connect one object to another object. In particular, the present invention relates to such apparatuses that are configured to connect the surface of one object to the surface of another object in a manner that keeps the two objects close together without allowing contact between the surfaces of the two objects. Even more particularly this invention relates to such apparatuses that are configured for use with boats and other objects that may have non-parallel surfaces and which one or both may be moving while being connected together.

B. Background

Many people enjoy going out on a lake, river, ocean or other body of water with a boat to engage in activities such as fishing, skiing, wake boarding or the like. In addition to engaging in such activities, many people also enjoy going out on a boat to spend time relaxing with family and friends, often in combination with one or more other activities. As is generally well known by persons who enjoy being on the water in a boat, many boating people often desire to get together with other persons, or groups of persons, who are on their own boat or boats so they may enjoy the boating time together. To accomplish this, the operators of the boats will collect in the same area of the body of water, such as in or near a cove or the like, turn off the engines or other power and "park" the boats near enough each other that they gather as a group. Whether such gatherings start out that way or not, often these gatherings of two or more boats become a reason to party with friends and family on the boats.

As will be readily appreciated by persons who have boats and who like to gather together with persons on one or more other boats, if left on their own the powerless boats will tend to either drift apart or drift into each other, neither of which is desirable. If the boats drift apart, then the people on the boats, many of whom may have moved between the boats, will not be able to be close enough to each other such that they can readily communicate with each other and share the time together. Such movement will require the operators of the boats to reposition one or more of the boats so they are together again. Depending on the conditions on the body of water, the requirement to reposition the boats so they stay together could be rather frequent. Allowing the boats to drift into each other is particularly not desirable. Many boats utilized for such purposes are expensive to purchase, have paint and/or other finishing work that is expensive and have owners who do not want their boats to be scratched or otherwise damaged as a result of contact with another boat (whatever the reason). In light of the fact that many boats are made out of fiberglass or like materials, the damage from the boats drifting into each other can be somewhat expensive to fix. Depending on the wind activity or wave motion, such as which results from being in another boat's wake, can result in the boats crashing into each other and producing minor to severe damage.

To avoid boats drifting apart or into each other, most boaters tie the boats together with one or more impact receiving devices held in place between the outwardly facing opposing surfaces of the two boats (i.e., the surfaces which are likely to contact each other as a result of drifting). Typically, the boats are tied together with a rope or another flexible elongated member, which is typically made out of materials that will not damage either boat, the ends of which are secured to each boat. The impact receiving devices may be one or more buoys, tires, tubes, balls or the like, which are typically made out of a relatively high impact plastic or the like, that will absorb the impact forces to avoid the two boats hitting each other. The impact receiving devices are commonly tied or otherwise connected to the rope or other elongated member that is utilized to connect the two boats together so as to hang between the two boats or along the opposing surface of one or both boats. It is also common to use the same flexible elongated members and impact receiving devices that are utilized to hold one boat generally adjacent another boat to connect a boat to another object, such as a dock or the like. In this use, one end of the rope or other elongated member is tied to the boat and the other end is tied to the dock or other object, with the impact receiving devices held between the opposing surfaces of the boat and the dock. The configuration and use of an elongated member and one or more impact receiving devices to protect boats from contacting each other are generally well known in the relevant art.

The use of flexible elongated members and impact receiving devices to connect and keep apart boats or a boat and another object has problems that are generally well known in the art. One such problem is the amount of storage that is needed for the ropes or other flexible elongated members and the buoys or other impact receiving devices when they are not in use. Another problem is that most boaters typically utilize more than one set of elongated members and impact receiving devices to secure and protect the boats at more than one location along the opposing surfaces of the boats. This results in the user having to handle multiple lengths of elongated members and impact receiving devices when he or she is tying the boats together or removing the materials to separate the boats, which is time consuming and generally considered an unpleasant task that has to be done. Yet another problem is that the impact receiving devices themselves can damage the surfaces of the boats by scraping off decals, producing scratch marks on the fiberglass and the like.

Therefore, despite the currently available prior art, what is needed is an improved apparatus for securing one boat to another boat or to an object that keeps the opposing surfaces of the boats or object sufficiently separate from each other so as to prevent any contact that could result in damage to the boats or to the object. The new apparatus should be configured to be securely attached to each of the boats or to the boat and the object so as to prevent the boats from drifting apart or the boat from drifting away from the object. The new apparatus should also be configured to keep the opposing surfaces of the two boats or the boat and the object in spaced apart relation to each other to prevent contact between the opposing surfaces. The new connecting/separating apparatus should be suitable for use on a wide variety of differently shaped boat surfaces and adaptable for use in the situation where the boat or boats are "rocking" in the water. Preferably, the new apparatus should be relatively compact so as to not require excessive storage space on a boat. The new apparatus should also be relatively quick and easy to use so as to not require a lot of set-up or take-down time. Preferably, the new connecting/separating apparatus should be configured to be relatively inexpensive to manufacture.

SUMMARY OF THE INVENTION

The connecting/separating apparatus of the present invention provides the benefits and solves the problems that are identified above. That is to say, the apparatus of the present invention is specially structured and arranged to be used to closely connect one boat to another boat or to connect a boat to an object such as a dock or the like in a manner that keeps the boat safely separate from the other boat or object. More specifically, the apparatus of the present invention connects a boat to another boat or to an object in a manner that keeps the opposing surfaces of the boats or object sufficiently separate from each other to prevent any contact that could result in damage to the boats or object. When utilized, the apparatus of the present invention securely attaches to each boat or to the boat and the object to prevent the boats from drifting apart or the boat from drifting away from the object while keeping the opposing surfaces of the boats or the boat and the object in spaced apart relation to each other to prevent contact between the opposing surfaces of the boats or boat and object. The apparatus of the present invention is configured to be utilized on a wide variety of differently shaped boat surfaces and to be adaptable for use where one or both of the boats are moving (i.e., rocking or the like) in the water in response to wind and/or wave action. In the preferred configurations of the new boat connecting/separating apparatus, the apparatus is relatively compact so as to not require excessive storage space on a boat and is relatively quick and easy to use, thereby significantly reducing the amount of set-up and take-down time compared to prior art devices. In one or more of the preferred embodiments, the new connecting/separating apparatus can be relatively inexpensive to manufacture.

In one embodiment of the present invention, the connecting/separating apparatus generally comprises at least a connecting assembly, a first engaging mechanism and a second engaging mechanism. The connecting assembly, which has a first end and a second end, comprises a first elongated connecting member, a second elongated connecting member and a length adjusting mechanism that is operatively connected to each of the first and second connecting members for allowing the user to adjust the length of the connecting assembly between a retracted position and an extended position in order to define a spacing amount between the surface of a boat and the surface of another object (which may be a second boat, a dock or the like). The first engaging mechanism, which is attached to or integral with the first end of the connecting assembly, is structured and arranged to removably connect to the surface of the boat. The first engaging mechanism comprises a lockable suction cup having an engaging surface and a cup locking mechanism, with the cup locking mechanism configured to place the suction cup in a locked condition with the engaging surface securely attached to the surface of the boat and in an unlocked condition allowing the suction cup to be removed from the surface of the boat. The second engaging mechanism, which is attached to or integral with the second end of the connecting assembly, comprises either a suction cup that is structured and arranged to removably connect to the surface of the object or a clip device that is structured and arranged to removably connect to a loop member associated with the surface of the object. As with the first engaging mechanism, the suction cup has an engaging surface and a cup locking mechanism, with the cup locking mechanism being configured to place the suction cup in a locked condition with the engaging surface securely attached to the surface of the object and in an unlocked condition allowing the suction cup to be removed from the surface of the object. Each of the connecting members are sufficiently stiff to prevent the surface of the boat from contacting the surface of object when the apparatus is connected to each of the boat and the object.

In a preferred configuration of the apparatus, at least one of the first connecting member and the second connecting member is tubular shaped and the other connecting member is received in an interior chamber of the tubular shaped connecting member so as to telescopically configure the connecting assembly in order to facilitate movement of the connecting assembly between the retracted position and the extended position thereof. The length adjusting mechanism has a locking mechanism that is structured and arranged to prevent movement of one of the first connecting member and the second connecting member relative to the other connecting member when the locking mechanism is in a locked condition so as to define the spacing amount and to allow movement of the second connecting member relative to the first connecting member when the locking mechanism is in an unlocked condition. In another embodiment, the length adjusting mechanism comprises a biasing mechanism that is disposed in the interior chamber and in operative engagement with the first and second connecting members, with the biasing mechanism being structured and arranged to bias the first connecting member and the second connecting member apart so as to automatically adjust the spacing amount. In this embodiment, the length adjusting mechanism further comprises a stopping mechanism that is configured to prevent full movement of either the first connecting member or the second connecting member in the interior chamber and to prevent complete separation of the first connecting member and the second connecting member. In one configuration, the stopping mechanism comprises a slot and a pin, with the pin being disposed through the slot to engage a first end of the slot when the connecting assembly is in the retracted position and to engage a second end of the slot when the connecting assembly is in the extended position. The preferred configuration of the new apparatus also comprises a pivoting mechanism that operatively interconnects the connecting assembly and at least one of the first engaging mechanism and the second engaging mechanism to allow the first engaging mechanism and/or the second engaging mechanism to pivot relative to the one or more elongated connecting members to allow for motion of the boat or the object as a result of wind or wave action or people moving between the boat or the object.

Accordingly, the primary object of the present invention is to provide a new boat connecting/separating apparatus that has the advantages set forth above and which overcomes the various disadvantages and limitations associated with presently available devices, apparatuses and systems for connecting a boat to another boat or object.

It is an important object of the present invention to provide a new boat connecting/separating apparatus that is specifically structured and arranged to be utilized to closely connect a first boat to second boat or to an object in a manner that prevents the first boat from contacting the second boat or object in order to allow people to move from the first boat to the second boat or object while preventing damage to the surfaces of the first boat and the second boat or object.

An important aspect of the present invention is that it provides a new connecting/separating apparatus for safely connecting a boat to another boat or an object that accomplishes the objectives set forth above and elsewhere in the present disclosure.

Another important aspect of the present invention is that it provides a new apparatus for safely connecting a boat to another boat or object that securely connects the boat to another boat or object in a manner that keeps the boat in spaced apart relation to the other boat or object so as to prevent undesirable contact between the boats or the boat and the object.

Another important aspect of the present invention is that it provides a new connecting/separating apparatus for safely connecting a boat to another boat or to a dock or other object in a manner that keeps the opposing surfaces of the boats or object sufficiently separate from each other to prevent any contact between the surfaces that could result in damage to the boats or object.

Another important aspect of the present invention is that it provides a new connecting/separating apparatus for safely connecting a boat to another boat or object to prevent the boats from drifting apart or the boat from drifting away from the object while keeping the opposing surfaces of the boats or the boat and the object separate from each other to prevent contact between the opposing surfaces of the boats or boat and object, even if one or both of the boats are rocking in the water in response to wind or wave action.

Another important aspect of the present invention is that it provides a new connecting/separating apparatus for safely connecting a boat to another boat or object that is compact for ease of storage and relatively simple to use so as to not require significant set-up or take-down time.

Yet another important aspect of the present invention is that it provides a new connecting/separating apparatus for safely connecting a boat to another boat or object that is relatively inexpensive to manufacture.

As will be explained in greater detail by reference to the attached figures and the description of the preferred embodiments which follow, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the components of the boat connecting/separating apparatus of the present invention, as well as the examples of objects with which the new apparatus may be utilized, those skilled in the art will readily appreciate that the apparatus of the present invention is not so limited. In addition, the exemplary embodiments of the present invention is shown and described herein with only those components that are required to disclose the present invention. As such, it may be possible that some of the necessary elements for attaching and using the present invention are not shown or necessarily described below, but which are well known to persons who are skilled in the relevant art. As will be readily appreciated by such persons, the various elements of the present invention that are described below may take on any form consistent with forms that are readily realized by a person of ordinary skill in the art having knowledge of prior art adjustable connecting assemblies, suction cups and the like.

Figure 1:
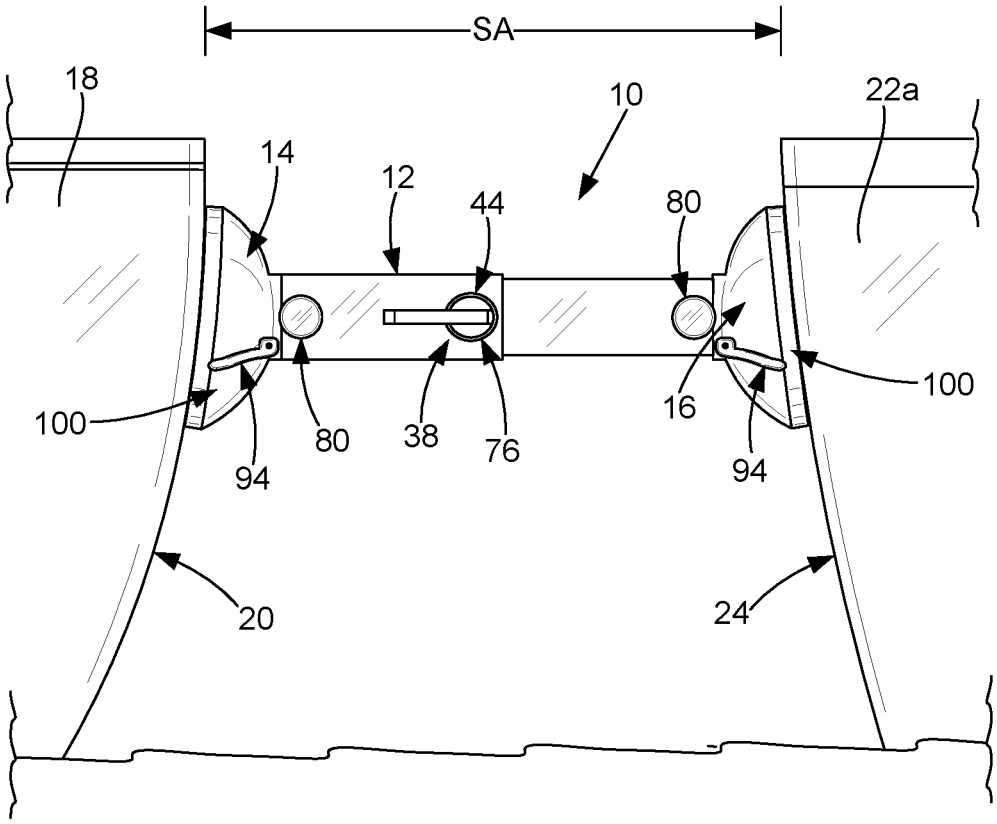
FIG. 1 is a side view of a boat connecting/separating apparatus that is configured according to a first embodiment of the present invention shown in use connecting the opposing surfaces of closely positioned boats.

A boat connecting/separating apparatus that is configured pursuant to preferred embodiments of the present invention is referred to generally as 10 in FIGS. 1-5 and 7-10. As shown in these figures and set forth in more detail below, the boat connecting/separating apparatus 10 of the present invention generally comprises a connecting assembly 12, a first engaging mechanism 14 and a second engaging mechanism 16. The new apparatus 10 of the present invention is utilized to safely connect a first boat 18, having an outwardly facing surface 20 (i.e., the side of the boat 18), to an object 22, such as second boat 22*a* or dock 22*b*, having an outwardly facing surface 24 (i.e., the side of the boat 22*a* or dock 22*b*) in a manner that prevents the surface 20 of the boat 18 from contacting the surface 24 of the object 22, as shown in FIGS. 1 and 11. As set forth in more detail below, the apparatus 10 of the present invention is specially structured and arranged to be used to closely connect a boat 18 to another object 22, such as a second boat 22*a*, dock 22*b* or the like in a manner that keeps the surface 20 of the first boat 18 in spaced apart relation, in an amount shown as the spacing gap SA in FIGS. 1 and 11, to the surface 24 of the other object 22. More specifically, the new apparatus 10 of the present invention connects a boat 18 to another object 22, such as a second boat 22*a*, a dock 22*b* or the like in a manner that keeps the opposing surfaces 20/24 sufficiently separate from each other, in the spacing amount SA, to prevent any contact between the surfaces 20/24 that could result in damage to the boat 18 or the object 22.

For purposes of describing the present invention, the object 22 to which the boat 18 connects may be any type of object that it would be useful and/or beneficial for the boat 18 to connect for purpose of placing the boat 18 generally adjacent to, but in spaced apart relation, the object 22. In the description that follows and the accompanying drawings, the object 22 is shown as a second boat 22*a* (FIG. 1) and a dock 22*b* (FIG. 11). As will be readily appreciated by persons who are skilled in the art, however, the object 22 may be a wide variety of different types of objects 22 to which the owner, operator or user of the first boat 18 may desire to connect to that is configured or which can be adapted to be utilized with the apparatus 10 of the present invention. In addition, for purposes of describing the use and relative location of the various components of the present invention, the term "surface" and the like is utilized to refer to a location on the boat 18 or the object 22 to which it is or may be beneficial for the apparatus 10 to connect when using the apparatus 10 to connect the boat 18 to the object 22 in a manner that achieves the objectives of the present invention. For instance, in the figures, the surface 20 of boat 18 is one of the side walls of the main body of the first boat 18 and the surface 22 of the object 22 is either a side wall of the main body of the second boat 22*a* or a side of the dock 22*b*. For further purposes of describing the apparatus 10 of the present invention, the terms "generally adjacent" refers to the two surfaces 20/24 of, respectively, boat 18 or object 22, being close enough to each other that the apparatus 10 can be utilized to connect the boat 18 to the object 22 but being spaced apart enough, in the spacing amount SA, to avoid the surfaces 20/24 contacting each other and causing damage to either the first boat 18 or the object 22 to which the boat 18 is connected. The term "opposing" or "opposite facing" when utilized in reference to the surfaces 20/24 refers to the two surfaces 20/24 that face toward each other when the boat 18 and object 22 are generally adjacent each other and connected (or able to be connected) by use of the apparatus 10. As will be readily appreciated by persons skilled in the relevant art, when the boat 18 and object 22 are generally adjacent and the apparatus 10 is utilized to connect the opposing surfaces 20/24 thereof, persons on the boat 18 or the object 22 will be able to walk back and forth between the boat 18 and object 22, persons on the boat 18 or object 22 will be able to easily communicate with other persons who are on either of the boat 18 or object 22, and food, drinks and other materials can be easily moved between the boat 18 and object 22.

As set forth above, the boat connecting/separating apparatus 10 of the present invention generally comprises connecting assembly 12, first engaging mechanism 14 and second engaging mechanism 16 that are cooperatively sized and configured to connect first boat 18 to an object 22, such as a second boat 22*a* or dock 22*b*, in a manner that prevents the first boat 18 drifting into the object 22 or the object 22 drifting or otherwise moving into the first boat 18 that could cause damage to one or both of the surfaces 20/24 thereof. As shown in FIGS. 1-5 and 7-11, the connecting assembly 12 interconnects the first engaging mechanism 14 and the second engaging mechanism 16 to position the apparatus 10 between the surfaces 20/24 of the first boat 18 and object 22. As shown in these figures, the first end 26 of the apparatus 10 is connected to the surface 20 of the first boat 18 and the second end 28 of the apparatus 10 connected to the surface 24 of the object 22. Likewise, the first engaging mechanism 14 is at the first end 30 of the connecting assembly 12 and the second engaging mechanism 16 is at the second end 32 of the connecting assembly 12. In the embodiments of FIGS. 1-5 and 7-9, each of the first engaging mechanism 14 and the second engaging mechanism 16 are lockable suction cups, respectively shown as 14*a* and 16*a*, that are structured and arranged to securely attach to the surfaces 20/24 of the boat 18 and object 22. In the embodiment of FIGS. 10-11, the second engaging mechanism 14 is a clip device 16*b* that is structured and arranged to securely attach to a loop member 34 that is attached to or near the surface 24 of dock 22*b* (as the object 22). The configuration and use of the lockable suction cups 14*a*/16*a* and the clip 16*b* with regard to the present invention are set forth below.

In the preferred embodiments of the present invention, the connecting assembly 12 is elongated and sized and configured to provide the spacing amount SA, which corresponds to the distance between the first 26 and second 28 ends of the apparatus 10, that is likely to be desired or needed by the users of apparatus 10 when they connect the first boat 18 to the object 22, as shown in FIGS. 1 and 11. In a preferred configuration, the connecting assembly 12 comprises two or more connecting members 36, such as connecting members 36*a* and 36*b* shown in the figures, and a length adjusting mechanism 38, as shown in FIGS. 1-5 and 7-11, that allows the user to adjust the length of the connecting assembly 12 and, therefore, the spacing amount SA between the surfaces 20/24. In an alternative configuration (not shown), the connecting assembly 12 can comprise a single connecting member 36 that is sized to provide a single spacing amount SA. As will be readily apparent to persons skilled in the art, the use of a variable length connecting assembly 12 allows the user to adjust the length of spacing assembly 12 to obtain a desired spacing amount SA, which may need to be adjusted to take into account an edge of the boat 18 or object 20 extending over or away from one or both ends 26/28 of the apparatus 10. In either embodiment, the connecting member 36 or connecting members 36*a*/36*b* should be sized and configured to be sufficiently strong in light of the forces likely to be placed thereon when the apparatus 10 is being utilized to connect and separate the first boat 18 from the object 22, particularly in light of any anticipated movement (i.e., as a result of wind and/or wave action) of either the boat 18 or the object 22. In addition, connecting member should be sufficiently rigid to maintain the desired spacing amount SA. The material for the connecting member 36 or connecting members 36*a*/36*b*, as well as all of the materials for apparatus 10, should be selected to be sufficiently weather, UV light, heat and corrosion resistant in light of the anticipated use for apparatus 10 with a boat 18 and object 22 in or near a body of water, such as a lake, river, ocean or the like.

As stated above, the preferred embodiment of connecting assembly 12 utilizes at least two connecting members, shown as first connecting member 36*a* and second connecting member 36*b* in FIGS. 2-5 and 7-10, that are joined by the length adjusting mechanism 38. In one configuration, at least one of the two connecting members 36*a*/36*b* is tubular so as to receive at least a portion of the other connecting member 36*a*/36 therein. In the embodiment shown in the figures, the length adjusting mechanism 38 comprises the first connecting member 36*a* being tubular and the second connecting member 36*b* being slidably received in the first connecting member 36*a* (though, as well known in the art, these may be reversed) to provide a telescopically configured connecting assembly 12. If desired, for ease of construction, lower cost or less weight, the second connecting member 36*b* can also be tubular. To adjust length of the connecting assembly 12 and, therefore, the spacing amount SA, the user slides the second connecting member 36 outward or inward relative to the first connecting member 36*a*. Such movement moves the connecting assembly 12 between, respectively, its extended condition 40 and its retracted condition 42, as shown with regard to FIG. 3 (extended) and FIG. 4 (retracted). The relative lengths of the first connecting member 36*a* and the second connecting member 36*b* will determine the range available for the user with regard to the spacing amount SA. In the embodiment of FIGS. 1-5, the length adjusting mechanism 38 is configured such that the second connecting member 36*b* is allowed to move freely relative to the first connecting member 36*a*, except as acted upon by the locking mechanism 44 (described below) that fixes the length of the connecting assembly 12.

Figure 9:
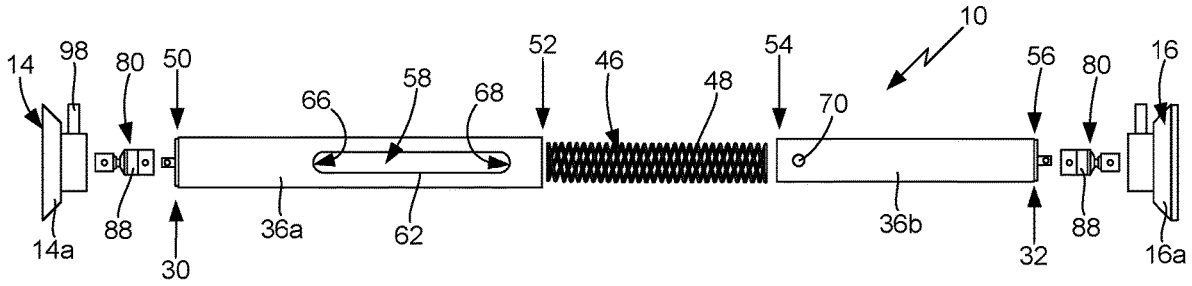
FIG. 9 is an exploded side view of the apparatus of FIG. 8.
Figure 10:
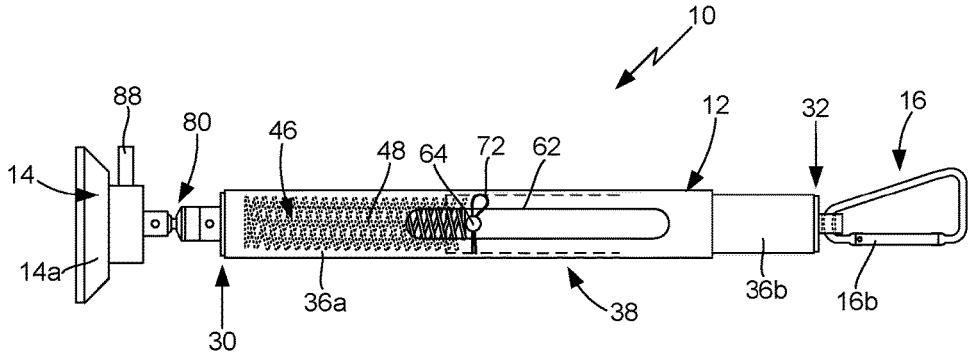
FIG. 10 is a side view of a boat connecting/separating apparatus that is configured according to a third embodiment of the present invention, with one end of the apparatus being configured with a clip that removably attaches to a connecting loop on a dock or other object.
Figure 11:
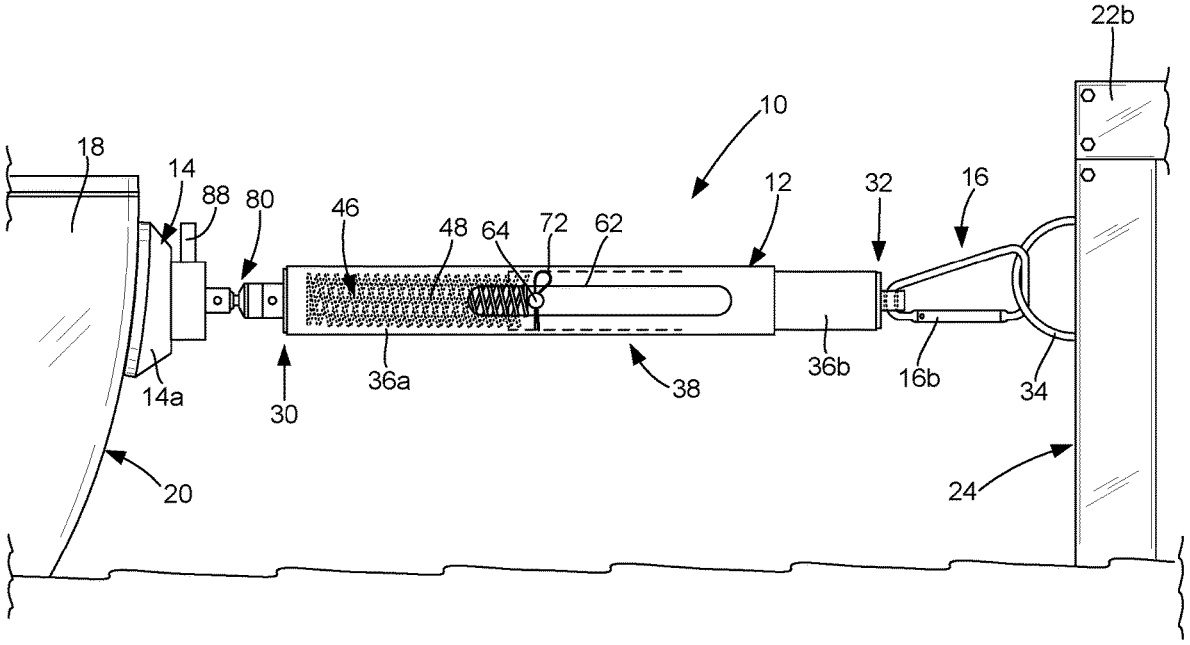
FIG. 11 is a side view of the apparatus of FIG. 10 shown in use connecting the surface of a boat to a connecting loop on the surface of a dock.

In the embodiment of FIGS. 7-11, the length adjusting mechanism 38 comprises a biasing mechanism 46 disposed inside the first connecting member 36*a* that is structured and arranged to engage the second connecting member 36*b* and to bias the second connecting member 36*b* away from the first connecting member 36*a*, which biases the connecting assembly 12 towards its extended position 40. In the embodiment shown in the figures, the biasing mechanism 46 comprises a spring 48, with the first connecting member 36*a* having a first end 50 that is generally toward the first end 30 of connecting assembly 12 and a second end 52 that is generally toward the second end 32 of connecting assembly 12 and the second connecting member 36*b* having a first end 54 that is generally toward the first end 30 of connecting assembly 12 and a second end 56 that is generally toward the second end 32 of connecting assembly 12, as best shown in FIG. 9. The biasing mechanism 46, such as spring 48, is disposed inside the interior chamber 58 of the first connecting member 36*a*, with one end thereof generally toward the first end 50 of the first connecting member 36*a* and the second thereof abutting or attached to the first end 54 of the second connecting member 36*b* so as to bias the second connecting member 36*b*. In alternative configurations, the biasing mechanism 46 may be pneumatic, hydraulic or the like. To prevent the second connecting member 36*b* from being biased completely out of the first connecting member 36*a*, which would allow the first boat 18 to drift away from the object 22, the length adjusting mechanism 38 of the embodiment of FIGS. 7-11 also comprises a stopping mechanism 60 that prevents the first end 54 of the second connecting member 36*b* from exiting the interior chamber 58 past the second end 52 of the first connecting member 36*a*.

In the embodiment shown in FIGS. 7-11, the stopping mechanism 60 comprises a slot 62 in the first connecting member 36*a* and a pin 64 associated with the second connecting member 36*b*. As best shown in FIG. 9, the slot 62 has a first end 66 and a second end 68 and the pin 64 is received through an aperture 70 in a tubular portion of the second connecting member 36*b* so as to extend through the slot 62, as shown in FIGS. 7-8 and 10-11. In the extended position 40, the body of the pin 64 will abut the second end 68 of the slot 62 and in the retracted position 42, the body of the pin 64 will abut the first end 66 of the slot 62. The ends of the pin 64 can be sized and configured to prevent the pin 64 from falling out of the slot 62 or, as shown in FIGS. 7-11, one or more connecting elements 72, such as cotter pins or the like, can be utilized to hold the pin 64 in its position within the slot 62. The configuration and use of stopping mechanisms 60 such as described above are generally well known in the art. In this embodiment, once the engaging mechanisms 14/16 of the apparatus 10 are attached to the surfaces 20/24, the apparatus 10 will hold the first boat 18 and the object 22 close together, with the biasing mechanism 46 and stopping mechanism 60 working together to allow the boat 18 and object 20 to move freely (i.e., drift as a result of wind or wave action) toward and away from each other, but only within the limits of the range of the pin 64 hitting the ends 66/68 of the slot 62 to prevent contact between the two surfaces 20/24 and the boat 18 and/or the object 22 drifting away from each other. The pin 64 can be a stainless steel, headless clevis pin or the like.

Figure 2:
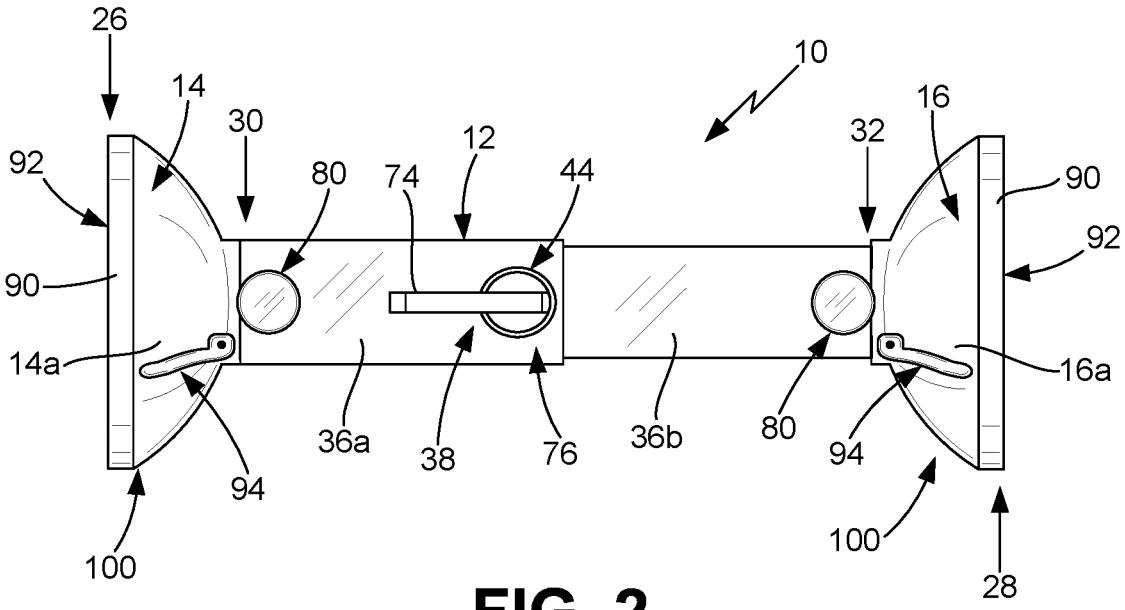
FIG. 2 is a side view of the apparatus of FIG. 1 shown separate from the two boats with each of the connecting assembly, first surface engaging mechanism and second engaging mechanism shown in their locked positions.
Figure 3:
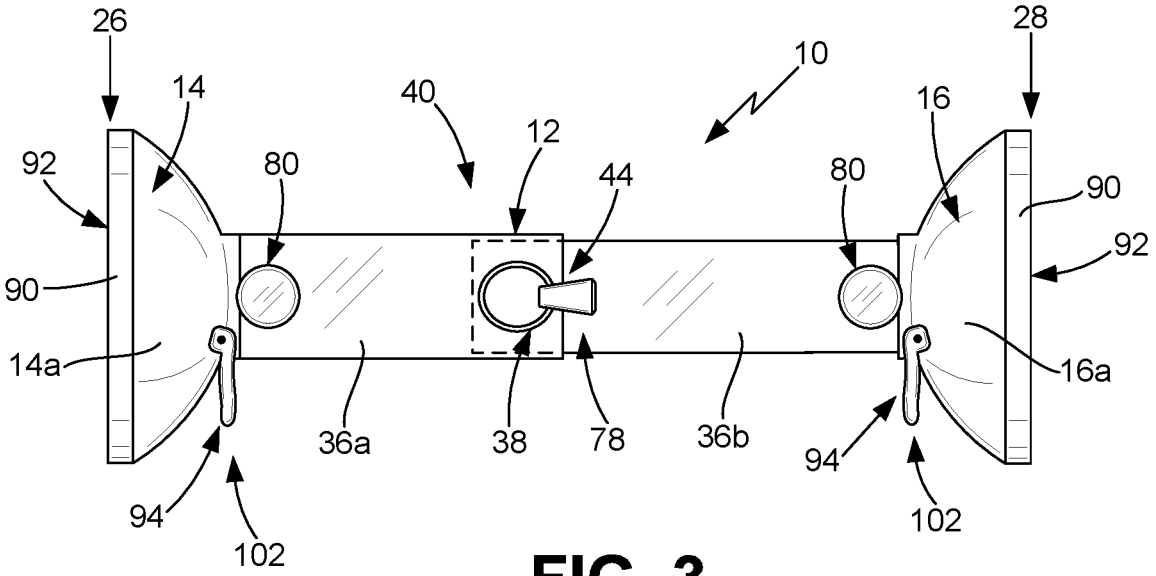
FIG. 3 is a side view of the apparatus of FIG. 2 with each of the connecting assembly, first surface engaging mechanism and second engaging mechanism shown in their unlocked positions and the connecting assembly in its extended condition.
Figure 4:
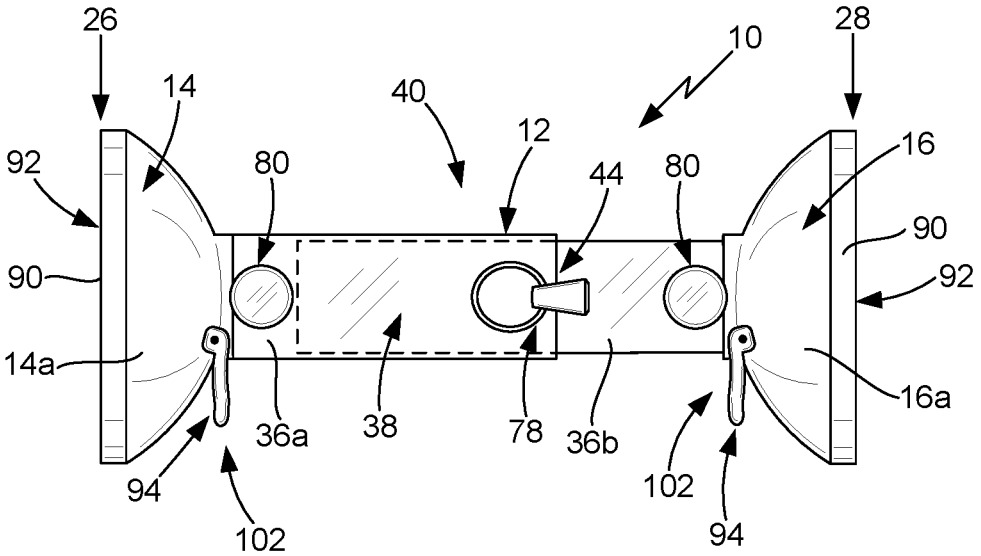
FIG. 4 is a side view of the apparatus of FIG. 3 with the connecting assembly in its retracted position.

With regard to the embodiment of the new boat connecting/separating apparatus 10 shown in FIGS. 1-5, the locking mechanism 44 is structured and arranged to prevent the first connecting member 36*a* and the second connecting member 36*b* from separating. In addition, the locking mechanism 44 is configured to hold the position of the second connecting member 36*b* in the interior chamber 58 of the first connecting member 36*a* so as to fix the length of the connecting assembly 12 and, therefore, the spacing amount SA provided by apparatus 10 between the surfaces 20/24. In the embodiment shown in the figures, the locking mechanism 44 has a handle 74 that allows the user to move locking mechanism 44 between its locked condition 76 (FIGS. 1-2 and 5) and its unlocked condition 78 (FIGS. 3-4). When in its locked condition 76, the locking mechanism 44 engages the second connecting member 36*b* to prevent any outward and inward movement of the second connecting member 36*b* relative to the first connecting member 36*a* and to fix the length of the connecting assembly 12. In this embodiment, the locking mechanism 44 clamps the second connecting member 36*b* inside the internal chamber 58 of the first connecting member 36*a*. The configuration and use of locking mechanism 44 that securely lock one member (such as the second connecting member 36*b*) inside a tubular member (such as the first connecting member 36*a*) to prevent relevant movement of the two members 36*a*/36*b* are generally well known in the art.

In one embodiment of the present invention, the connecting assembly 12 is configured in a fixed elongated, generally linear shape, whether comprising one or multiple connecting members 36. In the preferred embodiments of the new apparatus 10 of the present invention, however, the connecting assembly 12 comprises a pivoting mechanism 80 at one or both ends 30/32 thereof, as shown in FIGS. 1-11, that allows the apparatus 10 to be positioned against a boat 18 and/or an object 22 having different shapes of surfaces 20/24 and to allow the apparatus 10 to somewhat "flex" in response to any upward or downward movement of the boat 18 and/or object 22 that may occur as a result of wind or wave action. In the figures, the connecting assembly 12 has a pivoting mechanism 80 at each end 30/32 thereof. In certain circumstances, such as when connecting to a fixed dock 22*b*, it may not be necessary to have a pivoting mechanism 80 at both ends 30/32 of connecting assembly 12. The pivoting mechanisms 80 are structured and arranged to allow the first engaging mechanism 14 and the second engaging mechanism 16 to pivot relative to the connecting members 36 so each of the engaging mechanisms 14/16 can be positioned in abutting relation to the surfaces 20/24 of the first boat 18 and object 22, as shown in FIG. 1.

Figure 5:
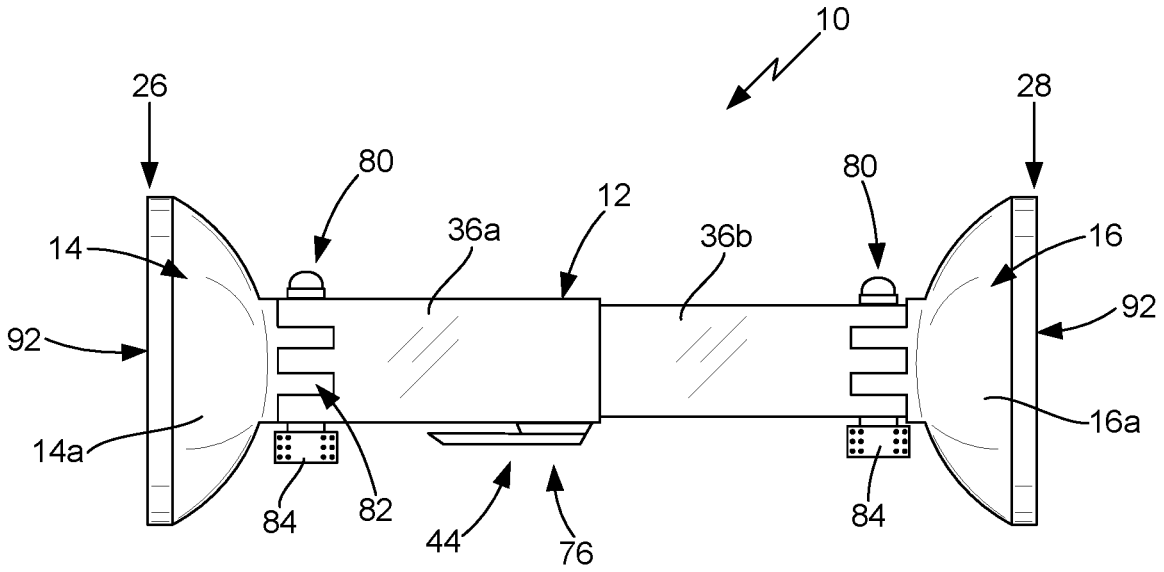
FIG. 5 is a top view of the apparatus of FIG. 2.
Figure 6:
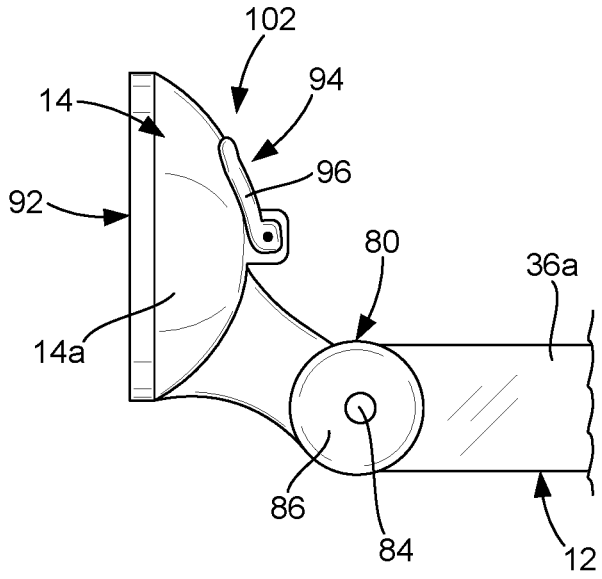
FIG. 6 is a side view of one end of the apparatus of FIG. 2 showing an alterative configuration for the pivot mechanism thereof.
Figure 7:
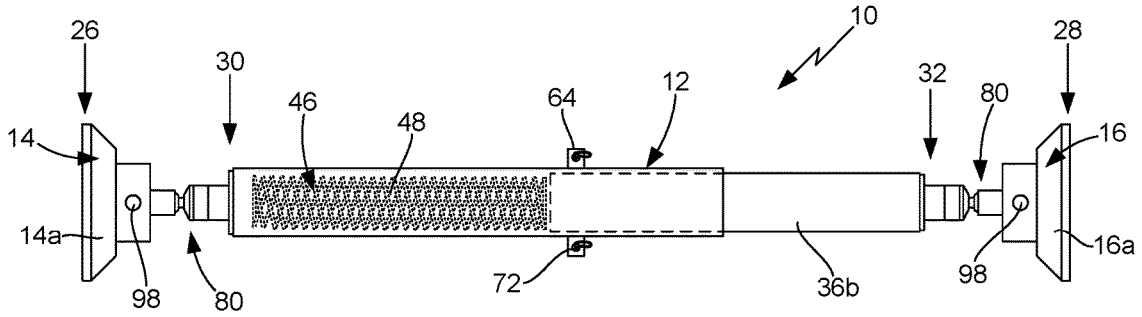
FIG. 7 is a top view of a boat connecting/separating apparatus that is configured according to a second embodiment of the present invention, with the connecting assembly of the apparatus shown in a partially extended condition.
Figure 8:
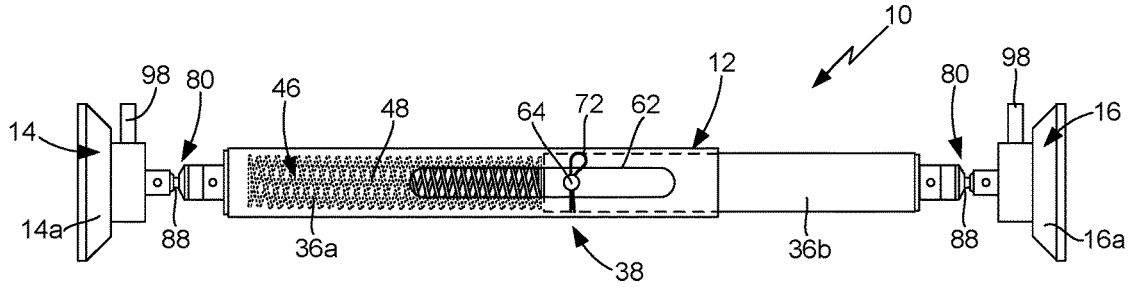
FIG. 8 is a side view of the apparatus of FIG. 7.

A variety of different types and configurations of pivoting mechanisms 80 can be utilized with the new apparatus 10 of the present invention. In FIGS. 1-5, pivoting mechanism 80 comprises a set of cooperatively configured interlocking members 82 that join the ends 30/32 of the connecting assembly 12 to the engaging mechanisms 14/16 with an appropriately configured connector 84, such as a pin or a bolt/nut type connector, that goes through each of the interlocking members 82, as best shown in FIG. 5, to allow one set of the interlocking members 82 to freely pivot relative to the other set and, therefore, allow the two engaging mechanisms 14/16 to pivot freely relative to the connecting members 36 of the connecting assembly 12. A different type of pivoting mechanism 80 is shown in the embodiment of FIG. 6. In this embodiment, the pivoting mechanism 80 comprises a spring-biased rotating device 86 having a connector 84 therethrough that allows the engaging mechanism 14/16 to pivot relative to the connecting assembly 12. In the embodiment of FIGS. 7-11, the pivoting mechanism 80 comprises a precision ball U-joint 88 that interconnects the ends 30/32 of the connecting assembly 12 and the engaging mechanisms 14/16 to allow the engaging mechanisms 14/16 to freely pivot relative to the connecting members 36 of the connecting assembly 12. Once the engaging mechanisms 14/16 are set against the surfaces 20/24, the ends 26/28 of the apparatus 10 will pivot up and down with the boat 18 and/or the object 22 in response, typically, to any wind or wave action. If desired, any of the above-described pivoting mechanisms 80 can be configured to be of the type that allows the user to fix the angle of one or both the engaging mechanisms 14/16 relative to the connecting members 36 of the connecting assembly 12. In this type of configuration, the user would place one of the engaging mechanisms 14/16 against its respective surface 20/24 and then tilt respective connecting member 36 to set the angle of the engaging mechanism 14/16 relative to the connecting assembly 12 and then repeat for the other engaging mechanism 14/16 at the other surface 20/24.

A variety of devices can be utilized for the engaging mechanisms 14/16 of the apparatus 10 of the present invention. In a preferred embodiment of the apparatus 10, both engaging mechanisms 14/16 are lockable suction cups 14*a* and 16*a* that are selected to engage the surfaces 20/24. The lockable suction cups 14*a*/16*a* for apparatus 10 should be selected to be able to securely engage the fiberglass surfaces that are commonly utilized for boats, such as the first boat 18 or second boat 22*a*. As well known in the art, most lockable suction cups 14*a*/16*a* have a surface engaging member 90, which may be attached to or integral with the body of the suction cups 14*a*/16*a*, that defines an engaging surface 92 that will tightly and securely engage the surfaces 20/24. To secure the suction cups 14*a*/16*a* to the surfaces 20/24, the suction cups 14*a*/16*a* have a cup locking mechanism 94, with a lever 96 (FIGS. 1-6) or a button 98 (FIGS. 7-11) associated therewith, that activates a built in pump mechanism that secures the suction cup 14*a*/16*a* to the surface 20/24. As well known in the art (i.e., suction cups that are utilized to secure an item to a shower wall, mirror, glass or like surfaces), the user will operate the lever 96 or button 98 to draw the surface engaging member 90 against the surface 20/24 so the engaging surface 92 of the suction cup 14*a*/16*a* will tightly engage the surface 20/24 and place the suction cup 14*a*/16*a* (engaging mechanisms 14/16) in its engaged condition 100, as shown in FIGS. 1 and 2. When the user operates the lever 96 or button 98 in the reverse direction, the suction cups 14*a*/16*a* will be placed in their disengaged condition 102, as shown in FIGS. 3 and 4. The configuration and use of such cup locking mechanisms 94 with lockable suction cups 14*a*/16*a* are also generally well known in the relevant art.

The embodiment of FIGS. 10 and 11 show a different configuration for the new apparatus 10 of the present invention. In this embodiment, the second engaging mechanism 14 comprises a clip device 16*b* that is structured and arranged to removably engage a loop member 34 that is attached to the dock 22*b*, generally at or near the surface 24 thereof. A wide variety of different types of clip devices are likely suitable for use as clip device 16*b*, including the type that are commonly referred to as carabineers and the like. In the embodiment shown in FIGS. 10 and 11, the clip device 16*b* connects to the pivoting mechanism 80. In an alternative configuration, however, the clip device 16*b* can connect directly to one end 30/32 of the connecting assembly 12 (i.e., when no pivoting mechanism 80 is utilized with apparatus 10).

As will be readily appreciated by persons skilled in the art, the various components of the new apparatus 10 for easily, quickly, securely and safely connecting a boat 18 to an object 22, such as another boat 22*a* or a dock 22*b*, can be manufactured out of a wide variety of different materials. In one configuration, at least the connecting members 36*a*/36*b* of the connecting assembly 12 and the body of the suction cups 14*a*/16*a* are made out of plastic or the like that is selected so as to not scratch or otherwise damage the surfaces 20/24. The various pins, connectors, levers, buttons, springs and like components may need to be made out of metal or the like for added strength. If so, these components should be made out of a material that will retain its function and strength in light of the environment in which the new apparatus 10 will be utilized. Typically, this will require such components to be made out of stainless steel, carbon fiber or the like or to be powder coated or otherwise treated.

In use, the operators of the two boats 18/22*a* will maneuver their respective boats 18/22*a* near each other or the operator of the first boat 18 will maneuver his or her boat next to the dock 22*b* or other object 22. Once the boat 18 is near the object 22, the user will place the apparatus 10 between the first boat 18 and the object 22. The first engaging mechanism 14 will engage the surface 20 of the first boat 18 and the second engaging mechanism 16 will engage the surface 24 of the object 22. In one use, the apparatus 10 is utilized to securely connect yet keep separate two boats 18/22*a*. To use apparatus 10 with two boats 18/22*a*, the lockable suction cup 14*a* is pressed against the surface 20 of the first boat 18 and the cup locking mechanism 94 thereof is operated to tightly press the engaging surface 92 of the suction cup 14*a* against the surface 20 of the first boat 18 and then the lockable suction cup 16*a* is pressed against the surface 24 of the second boat 22*a* and the cup locking mechanism 94 thereof is operated to tightly press the engaging surface 92 of the suction cup 16*a* against the surface 24 of the second boat 22*a*. As set forth above, the suction cups 14*a*/16*a* are engaged by moving the lever 96, button 98 or other device in the appropriate manner. In the embodiment where the connecting assembly 12 has locking mechanism 44 to lock the length adjusting mechanism 38 (i.e., as shown in FIGS. 1-5), the user places the locking mechanism 44 in its locked condition 76, typically with the connecting assembly 12 somewhere between its extended position 40 and its retracted position 42, to set the distance between the surfaces 20/24. In the embodiment having the biasing mechanism 46, it will not be necessary for the user to set the length adjusting mechanism 38, as the length of the connecting assembly 12 will automatically adjust (i.e., as the pin 64 moves between the ends 66/68 of the slot 62) as the two boats 18/22*a* move as a result of wind or wave action or as people move back and forth from one boat 18/22*a* to the other boat 18/22*a*. The above description also applies where the object 22 is a dock 22*b* and the user desires to secure the first boat 18 to the surface 24 of the dock 22*b*. In the embodiment where the clip device 16*a* is utilized as the second engaging mechanism 16, the user opens or otherwise operates the clip device 16*a* to engage it with the loop member 36 to secure the second end 28 of the apparatus 10 to the dock 22*b* or like object. In any use of the new apparatus 10, when the user desires to separate the boats 18/22*a* or the boat 18 from the dock 22*b*, he or she merely has to disengage the engaging mechanisms 14/16 from their respective surfaces 20/24 and, as applicable, place the locking mechanism 44 in its unlocked condition 78. The apparatus 10 can then be easily handled and stored. As will be readily appreciated by persons skilled in the art, because the apparatus 10 is relatively compact, it will not require excessive storage space on a boat and, relative to prior art devices, the apparatus 10 will significantly reduce the amount of set-up and take-down time to connect two boats 18/22*a* together or a boat 18 to a dock 22*b*. In addition, because many of the components for the new apparatus 10 are either off-the-shelf or easily made, the new apparatus 10 will be relatively inexpensive to manufacture.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. An apparatus for connecting a boat having a surface to an object having a surface, said apparatus comprising:

a connecting assembly having a first connecting member defining a first end, a second connecting member defining a second end and a length adjusting means operatively connected to each of said first connecting member and said second connecting member for adjusting the length of said connecting assembly between a retracted position and an extended position so as to define a spacing amount between the surface of a boat and the surface of the object, at least one of said first connecting member and said second connecting member is tubular shaped and the other of said first connecting member and said second connecting member is received in an interior chamber of said tubular shaped connecting member so as to telescopically configure said connecting assembly to facilitate movement of said connecting assembly between said retracted position and said extended position thereof, said length adjusting means comprises a biasing mechanism disposed in said interior chamber and in operative engagement with said first connecting member and said second connecting member, said biasing mechanism being structured and arranged to bias said first connecting member and said second connecting member apart so as to automatically adjust said spacing amount;

a first engaging mechanism attached to or integral with said first end of said connecting assembly, said first engaging mechanism structured and arranged to removably connect to the surface of the boat, said first engaging mechanism comprising a suction cup having an engaging surface and a cup locking mechanism, said cup locking mechanism configured to place said suction cup in a locked condition with said engaging surface securely attached to the surface of the boat and in an unlocked condition allowing said suction cup to be removed from the surface of the boat; and a second engaging mechanism attached to or integral with said second end of said connecting assembly, said second engaging mechanism structured and arranged to removably connect to the surface of the object, wherein each of said first connecting member and said second connecting member are sufficiently stiff to prevent the surface of the boat from contacting the surface of the object when said apparatus is connected to each of the boat and the object.

2. The apparatus of claim 1, wherein said second engaging mechanism comprises a suction cup structured and arranged to removably connect to the surface of the object, said suction cup having an engaging surface and a cup locking mechanism, said cup locking mechanism configured to place said suction cup in a locked condition with said engaging surface securely attached to the surface of the object and in an unlocked condition allowing said suction cup to be removed from the surface of the object.

3. The apparatus of claim 1, wherein said length adjusting means further comprises a locking mechanism structured and arranged to prevent movement of one of said first connecting member and said second connecting member relative to the other of said first connecting member and said second connecting member when said locking mechanism is in a locked condition so as to define said spacing amount and to allow movement of said second connecting member relative to said first connecting member when said locking mechanism is in an unlocked condition.

4. The apparatus of claim 1, wherein said length adjusting means further comprises a stopping mechanism configured to prevent full movement of one of said first connecting member or said second connecting member in said interior chamber and to prevent complete separation of said first connecting member and said second connecting member.

5. The apparatus of claim 4, wherein said stopping mechanism comprises a slot and a pin, said pin disposed through said slot so as to engage a first end of said slot when said connecting assembly is in said retracted position and to engage a second end of said slot when said connecting assembly is in said extended position.

6. The apparatus of claim 1, wherein said second engaging mechanism comprises a clip device structured and arranged to removably connect to a loop member associated with the surface of the object.

7. The apparatus of claim 1 further comprising a pivoting mechanism operatively interconnecting said connecting assembly and at least one of said first engaging mechanism and said second engaging mechanism so as to allow said first engaging mechanism to pivot relative to said first connecting member and/or said second engaging mechanism to pivot relative to said second connecting member.

8. An apparatus for connecting a boat having a surface to an object having a surface, said apparatus comprising:

a connecting assembly having a first end and a second end, said connecting assembly comprising an elongated first connecting member, an elongated second connecting member and a length adjusting means operatively connected to each of said first connecting member and said second connecting member for adjusting the length of said connecting assembly between a retracted position and an extended position so as to define a spacing amount between the surface of the boat and the surface of the object, at least one of said first connecting member and said second connecting member being tubular shaped and the other of said first connecting member and said second connecting member being received in an interior chamber of said tubular shaped connecting member so as to telescopically configure said connecting assembly to facilitate movement of said connecting assembly between said retracted position and said extended position thereof, said length adjusting means comprising a biasing mechanism disposed in said interior chamber and in operative engagement with said first connecting member and said second connecting member, said biasing mechanism being structured and arranged to bias said first connecting member and said second connecting member apart so as to automatically adjust said spacing amount;

a first engaging mechanism attached to or integral with said first end of said connecting assembly, said first engaging mechanism structured and arranged to removably connect to the surface of the boat, said first engaging mechanism comprising a suction cup having an engaging surface and a cup locking mechanism, said cup locking mechanism configured to place said suction cup in a locked condition with said engaging surface securely attached to the surface of the boat and in an unlocked condition allowing said suction cup to be removed from the surface of the boat; and a second engaging mechanism attached to or integral with said second end of said connecting assembly, said second engaging mechanism comprising a suction cup structured and arranged to removably connect to the surface of the object, said suction cup having an engaging surface and a cup locking mechanism, said cup locking mechanism configured to place said suction cup in a locked condition with said engaging surface securely attached to the surface of the object and in an unlocked condition allowing said suction cup to be removed from the surface of the object, wherein each of said one or more connecting members are sufficiently stiff to prevent the surface of the boat from contacting the surface of the object when said apparatus is connected to each of the boat and the object.

9. The apparatus of claim 8, wherein said length adjusting means comprises a locking mechanism structured and arranged to prevent movement of one of said first connecting member and said second connecting member relative to the other of said first connecting member and said second connecting member when said locking mechanism is in a locked condition so as to define said spacing amount and to allow movement of said second connecting member relative to said first connecting member when said locking mechanism is in an unlocked condition.

10. The apparatus of claim 8, wherein said length adjusting means further comprises a stopping mechanism configured to prevent full movement of one of said first connecting member or said second connecting member in said interior chamber and to prevent complete separation of said first connecting member and said second connecting member.

11. The apparatus of claim 10, wherein said stopping mechanism comprises a slot and a pin, said pin disposed through said slot so as to engage a first end of said slot when said connecting assembly is in said retracted position and to engage a second end of said slot when said connecting assembly is in said extended position.

12. The apparatus of claim 8 further comprising a pivoting mechanism operatively interconnecting said connecting assembly and at least one of said first engaging mechanism and said second engaging mechanism so as to allow said first engaging mechanism to pivot relative to said first connecting member and/or said second engaging mechanism to pivot relative to said second connecting member.

13. An apparatus for connecting a boat having a surface to an object having a surface, said apparatus comprising:

a connecting assembly having a first end and a second end, said connecting assembly comprising an elongated first connecting member, an elongated second connecting member and a length adjusting means operatively connected to each of said first connecting member and said second connecting member for adjusting the length of said connecting assembly between a retracted position and an extended position so as to define a spacing amount between the surface of the boat and the surface of the object, said first connecting member being tubular shaped so as to define an interior chamber and said second connecting member is tubular shaped and the other of said first connecting member and said second connecting member is received in an interior chamber of said tubular shaped connecting member so as to telescopically configure said connecting assembly to facilitate movement of said connecting assembly between said retracted position and said extended position thereof;

a biasing mechanism disposed in said interior chamber and in operative engagement with said first connecting member and said second connecting member, said biasing mechanism being structured and arranged to bias said first connecting member and said second connecting member apart so as to automatically adjust said spacing amount;

a first engaging mechanism attached to or integral with said first end of said connecting assembly, said first engaging mechanism structured and arranged to removably connect to the surface of the boat, said first engaging mechanism comprising a suction cup having an engaging surface and a cup locking mechanism, said cup locking mechanism configured to place said suction cup in a locked condition with said engaging surface securely attached to the surface of the boat and in an unlocked condition allowing said suction cup to be removed from the surface of the boat; and a second engaging mechanism attached to or integral with said second end of said connecting assembly, said second engaging mechanism comprising a suction cup structured and arranged to removably connect to the surface of the object, said suction cup having an engaging surface and a cup locking mechanism, said cup locking mechanism configured to place said suction cup in a locked condition with said engaging surface securely attached to the surface of the object and in an unlocked condition allowing said suction cup to be removed from the surface of the object, wherein each of said one or more connecting members are sufficiently stiff to prevent the surface of the boat from contacting the surface of the object when said apparatus is connected to each of the boat and the object.

14. The apparatus of claim 13 further comprising a pivoting mechanism operatively interconnecting said connecting assembly and at least one of said first engaging mechanism and said second engaging mechanism so as to allow said first engaging mechanism and/or said second engaging mechanism to pivot relative to said one or more elongated connecting members.

15. The apparatus of claim 14, wherein said length adjusting means comprises a locking mechanism structured and arranged to prevent movement of one of said first connecting member and said second connecting member relative to the other of said first connecting member and said second connecting member when said locking mechanism is in a locked condition so as to define said spacing amount and to allow movement of said second connecting member relative to said first connecting member when said locking mechanism is in an unlocked condition.

16. The apparatus of claim 13, wherein said length adjusting means comprises a locking mechanism structured and arranged to prevent movement of one of said first connecting member and said second connecting member relative to the other of said first connecting member and said second connecting member when said locking mechanism is in a locked condition so as to define said spacing amount and to allow movement of said second connecting member relative to said first connecting member when said locking mechanism is in an unlocked condition.

* * * * *